United States Patent [19]

Katahira et al.

[11] 4,191,013

[45] Mar. 4, 1980

[54] DEVICE FOR PURIFYING EXHAUST GASES FROM INTERNAL COMBUSTION ENGINE

[75] Inventors: Eturou Katahira; Shunzo Yamaguchi, both of Okazaki; Masashi Kida, Nishio; Yasuhiko Ishida; Hideo Miyagi, both of Susono, all of Japan

[73] Assignees: Nippon Soken, Inc., Nishio; Toyota Jidosha Kogyo Kabushiki Kaisha, Toyota, both of Japan

[21] Appl. No.: 800,071

[22] Filed: May 24, 1977

[30] Foreign Application Priority Data

| | | | |
|---|---|---|---|
| Jun. 2, 1976 | [JP] | Japan | 51-65063 |
| Jun. 4, 1976 | [JP] | Japan | 51-65840 |
| Jun. 25, 1976 | [JP] | Japan | 51-84270[U] |

[51] Int. Cl.[2] ..... F01N 3/10

[52] U.S. Cl. ..... 60/276; 60/290

[58] Field of Search ..... 60/290, 276, 289; 123/124 R, 124 B; 251/31

[56] References Cited

U.S. PATENT DOCUMENTS

| | | | |
|---|---|---|---|
| 3,430,437 | 3/1969 | Saussele | 60/290 |
| 3,911,674 | 10/1975 | Goto | 60/278 |
| 3,919,843 | 11/1975 | Arnaud | 60/290 |
| 3,931,710 | 1/1976 | Hartel | 60/290 |
| 3,962,867 | 6/1976 | Ikeura | 60/290 |
| 4,007,718 | 2/1977 | Laprade | 123/124 B |

FOREIGN PATENT DOCUMENTS

| | | | |
|---|---|---|---|
| 2363726 | 7/1975 | Fed. Rep. of Germany | 60/276 |

*Primary Examiner*—Douglas Hart

*Attorney, Agent, or Firm*—Cushman, Darby & Cushman

[57] ABSTRACT

In a device for purifying the exhaust gases discharged from an internal combustion engine of the type having a secondary air supply pipe for charging the secondary air from an air source such as an air pump into an exhaust pipe upstream of an exhaust gas reactor or the like, a three-way valve is inserted in the supply pipe in such a manner that the three-way valve may be displaced between a first position at which the air source and the exhaust pipe are communicated with each other and a second position at which the communication between them is interrupted and the secondary air is relieved or returned to the air source bypassing the exhaust pipe; an air-fuel ratio sensor is inserted into the exhaust pipe downstream of the opening of the secondary air supply pipe into the exhaust pipe; and means for controlling the three-way valve is provided so that when the air-fuel ratio detected by the sensor is lower than a reference or optimum ratio at which the best performance of the reactor is expected the three-way valve is caused to move to the first position, whereas when the sensed air-fuel ratio exceeds the reference ratio, the three-way valve is caused to move to the second position, whereby the air-fuel ratio may be controlled with a higher degree of accuracy.

2 Claims, 11 Drawing Figures

DEVICE FOR PURIFYING EXHAUST GASES FROM INTERNAL COMBUSTION ENGINE

BACKGROUND OF THE INVENTION

1. FIELD OF THE INVENTION

The present invention relates to generally a device for purifying the exhaust gases discharged from an internal combustion engine and more particularly an exhaust gas purifying device of the type having an exhaust gas reactor or the like, a secondary air supply system and an air-fuel ratio senser so that the air-fuel ratio detected in the exhaust gases (to be defined below) may be controlled at an optimum ratio at which the best performance of the reactor or the like may be expected.

2. DESCRIPTION OF THE PRIOR ART

The so-called three-way catalyst, wherein a common catalyst bed carries catalysts for oxidizing carbon monoxide (CO) and hydrocarbons (HC) and reducing nitrogen oxides (NOx) in the exhaust gases, thereby purifying these pollutants, exhibits in general the pollutant purifying characteristic shown in FIG. 1. As is seen from FIG. 1, the air-fuel ratio detected in the exhaust gases must be maintained within a hatched area in FIG. 1 so that the three-way catalyst may operate at an optimum efficiency.

To this end there has been devised and demonstrated a system of the type wherein the secondary air discharged from an air pump driven by an engine is charged through a secondary air control valve into an exhaust pipe to control the air-fuel ratio in such a way that a reactor or the like may operate most efficiently. In this specification, the term "exhaust-gas air-fuel ratio" will be used and is defined by the following relation:

$$\text{Exhaust-gas air-fuel ratio} = \frac{\text{intake air} + \text{secondary air}}{\text{fuel}} \text{ (by weight)}$$

The intake air and fuel are mixed in a carburetor and charged into the cylinders of the engine, whereas the secondary air is charged into the exhaust pipe upstream of the reactor.

The secondary air control valve is a two-way valve; that is a valve for opening or closing a secondary air supply passage. However, when the initially wide opened two-way valve is being closed, the flow rate of secondary air passing therethrough remains almost unchanged and is substantially equal to the flow rate when the valve is wide opened, immediately before the valve is completely closed. As a result, an excessive quantity of secondary air is charged into the exhaust pipe so that with the prior art secondary air supply devices it is impossible to control the "exhaust-gas air-fuel ratio" with a higher degree of accuracy, and consequently the "exhaust-gas air-fuel ratio" varies over a wide range.

So far diaphragms have been widely used for controlling the two-way valves, but when the volumes of two pressure chambers defined above and below a diaphragm are different from each other, there is a difference between a time required for closing the two-way valve and a time required for opening it so that the "exhaust-gas air-fuel ratio" cannot be controlled with a higher degree of accuracy and in a quick response.

SUMMARY OF THE INVENTION

In view of the above, one of the objects of the present invention is to provide a secondary air supply apparatus for use in an internal combustion engine which may substantially solve the above problems and may correctly maintain the "exhaust-gas air-fuel ratio" at an optimum level with a higher degree of accuracy and may quickly correct any deviation therefrom.

Another object of the present invention is to provide a secondary air supply apparatus wherein a three-way valve is inserted in such a way that one of the two discharge ports is communicated with the exhaust pipe for charging the secondary air therein whereas the other port is used for relieving or bypassing the secondary air to be discharged from an air pump to the exhaust pipe when said one port is being closed, whereby the secondary air charged into the exhaust pipe may be correctly controlled in quantity.

A further object of the present invention is to provide a very useful secondary air supply apparatus for use in an internal combustion engine wherein a diaphragm, which defines two pressure chambers above and below it, is used for driving said three-way valve and is provided with means for adjusting the two pressure chambers to have a same volume so that the "exhaust-gas air-fuel ratio" may be controlled with a higher degree of accuracy and any deviation from a reference ratio may be quickly corrected.

A still further object of the present invention is to provide a secondary air supply apparatus for use in an internal combustion engine wherein a solenoid-operated valve is used as said three-way valve so that the "exhaust-gas air-fuel ratio" may be controlled with a higher degree of accuracy hitherto unattainable by the prior art and any deviation from a reference ratio may be quickly corrected.

Many other features, advantages and additional objects of the present invention will become manifest to those versed in the art upon making reference to the detailed description which follows and the accompanying drawings.

DESCRIPTION OF THE PREFERRED EMBODIMENTS

Figure 1:
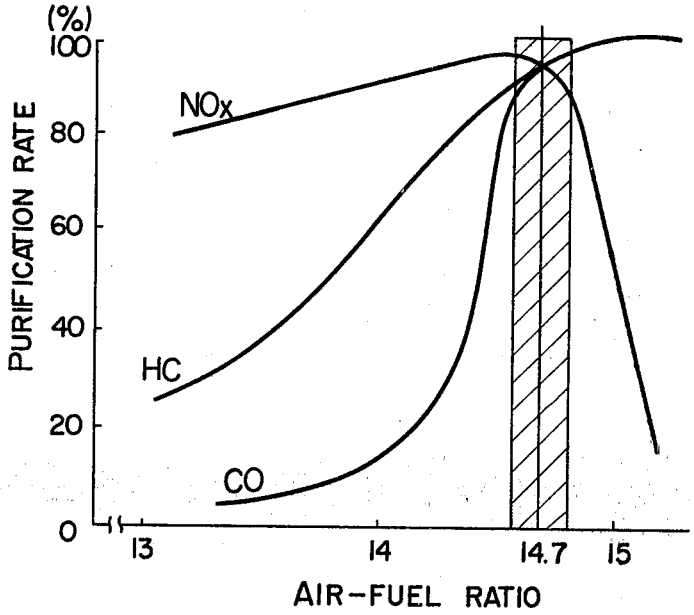
FIG. 1 shows the pollutant purifying characteristics of a three-way catalyst.

First referring to FIG. 2, the first embodiment of the present invention will be described. Reference numeral 1 denotes an internal combustion engine; 2, an air cleaner; 3, an intake manifold; 4, a carburetor so adjusted to maintain an air-fuel ratio slightly richer than the theoretical air-fuel ratio; 5, a throttle valve for controlling the air-fuel mixture to be supplied through the intake manifold 3 to the engine 1, the exhaust gases being discharged through an exhaust pipe 6; 7, an air-fuel ratio sensor of a conventional type for detecting the air-fuel ratio in terms of the oxygen content in the exhaust gases, the relation between the air-fuel ratio and the output from the senser 7 being shown in FIG. 3; and 8, a pre-catalyst inserted in the exhaust pipe 6, the air-fuel ratio senser 7 being disposed immediately downstream of the pre-catalyst 8 so that it may operate at a stable environmental temperature and consequently the satisfactory output characteristic may be ensured.

An exhaust gas reactor 9 which is disposed downstream of the air-fuel ratio senser 7 utilizes a three-way catalyst, which as is well known in the art promotes the oxidation and reduction of CO, HC and NOx in the exhaust gases. The performance of this reactor 9 for purifying these pollutants is seen from FIG. 1, all of CO, HC and NOx being purified at considerably high rates especially when the "exhaust-gas air-fuel ratio" is at or near the theoretical air-fuel ratio 14.7.

An air pump 10 which is driven by the engine 1 has its intake port communicated through an intake pipe 11 with the air cleaner 2 and its discharge port communicated through a supply pipe 12 with the exhaust pipe 6 upstream of the pre-catalyst 8. One end of a bypass pipe 13 is communicated with the supply pipe 12 whereas the other end, with the air cleaner 2.

A three-way valve 20 inserted into the supply pipe 12 consists of a valve body 21 adapted to establish and interrupt the communication between the supply pipe 12 and the bypass pipe 13, a diaphragm 22 adapted to be displaced upward or downward in response to the pressure difference thereacross, a shaft 23 adapted to transmit the displacement of this diaphragm 22 to the valve body 21, and a first pressure chamber 24 and a second pressure chamber 25 defined below and above the diaphragm 22, respectively. A nonreturn (check) valve 26 is inserted into the supply pipe 12 to prevent the reverse flow of the exhaust gases through the supply pipe 12. A first solenoid-operated three-way valve 30 has its first, second and third ports communicated with the intake manifold 3, the surrounding atmosphere and the first pressure chamber 24 of the three-way valve 20, respectively, and is adapted to transmit the negative pressure to the first pressure chamber 24 only when the valve 30 is kept de-energized. A second solenoid-operated three-way valve 31 has its first, second and third ports communicated with the intake manifold 3, the surrounding atmosphere and the second pressure chamber 25 of the three-way valve 20, respectively, and is adapted to transmit the negative pressure to the second pressure chamber 25 only when the valve 31 is kept energized.

The three-way valve 20 is not provided with a spring for biasing the diaphragm 22 so that the diaphragm 22 may be extremely sensitive to the pressure difference between the first and second pressure chambers 24 and 25 and may be displaced upward or downward accordingly.

Figure 4:
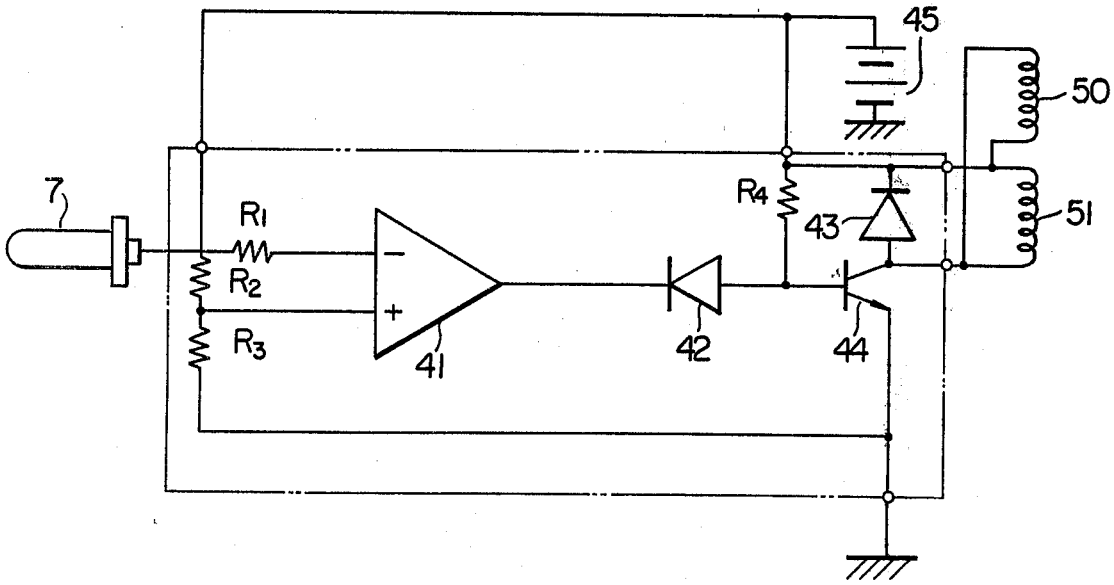
FIG. 4 is a diagram of a control circuit 40 of the first embodiment.

A control circuit 40 is responsive to the output from the air-fuel ratio senser 7 for controlling the first and second solenoid-operated valves 30 and 31, and will be described in detail in conjunction with FIG. 4. The control circuit 40 includes a comparator 41 which compares the output transmitted through a first resistor R-1 from the air-fuel ratio senser 7 with a reference voltage set by a second and a third resistors R-2 and R-3; a first diode 42; a second diode 43; a transistor 44, first and second solenoid coils 50 and 51 for driving the first and second solenoid-operated three-way valves 30 and 31, respectively; a fourth resistor R-4 and a power supply 45.

Figure 3:
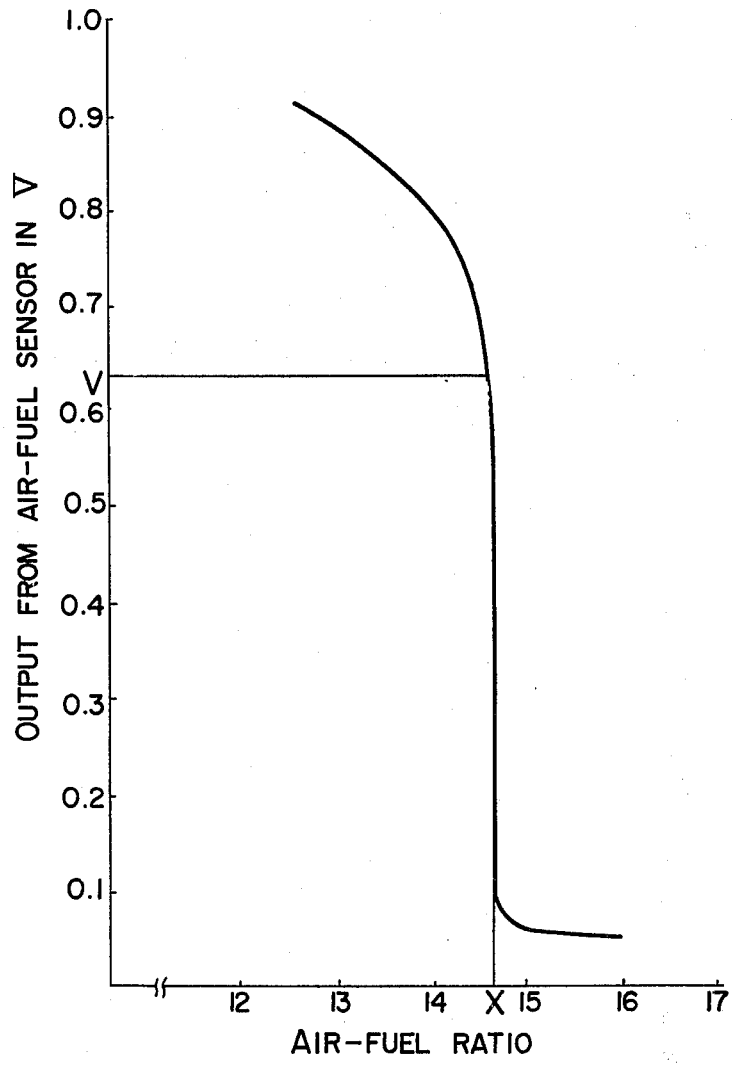
FIG. 3 shows the output characteristic of an air-fuel ratio senser used in the first embodiment.

Referring further to FIG. 3, when the "exhaust-gas air-fuel ratio" is lower than a reference ratio X, the output from the air-fuel ratio senser 7 exceeds a reference voltage V so that the voltage impressed to the negative terminal of the comparator 41 exceeds the voltage impressed on the positive terminal. As a result, the output from the comparator 41 is "0" or at 0 level. On the other hand when the "exhaust-gas air-fuel ratio" exceeds the reference ratio X, the voltage impressed on the negative terminal is lower than the reference voltage impressed on the positive terminal and consequently the output is "1" or at 1 level.

When the output from the comparator 41 is "0", neither of the solenoid coils 50 and 51 of the solenoid-operated three-way valves 30 and 31 are kept de-energized so that the negative intake pressure is transmitted through the first solenoid-operated valve 30 to the first pressure chamber 24 of the three-way valve 20, whereas the atmospheric pressure is transmitted through the second solenoid-operated valve 31 to the second pressure chamber 25. As a result, the bypass pipe 13 is completely closed by the valve body 21 so that no relief operation is effected, whereas the supply pipe 12 is wide opened to supply a large amount of secondary air into the exhaust pipe 6. On the other hand, when the output from the comparator 41 is "1"; that is, when the air-fuel mixture is lean, both of the solenoid coils 50 and 51 are energized so that the atmospheric pressure is transmitted into the first pressure chamber 24 and the negative intake pressure, into the second pressure chamber 25. As a consequence, the valve body 21 completely closes the supply pipe 12 while wide opening the bypass pipe 13, thereby reliefing all of secondary air. This control circuit 40 and the first and second solenoid-operated three-way valves 30 and 31 constitute control means for controlling the three-way valve 20.

As the three-way valve 20 alternately opens and closes, the secondary air is charged into and mixed with the exhaust gases in a pulse-like manner so that the "exhaust-gas air-fuel ratio" of the exhaust gases to be charged into the reactor 9 changes cyclically, but the desired or reference ratio X may be attained on the average. Thus the high efficiency of the reactor 9 may be ensured. It will be understood that when the period of the cyclic change in the air-fuel ratio is shortened so that the satisfactory mixing of the exhaust gases with the secondary air in the reactor 9 may be attained and consequently the deviation of the air-fuel ratio may be minimized, the pollutant purifying efficiency of the reactor 9 may be further improved.

Figure 2:
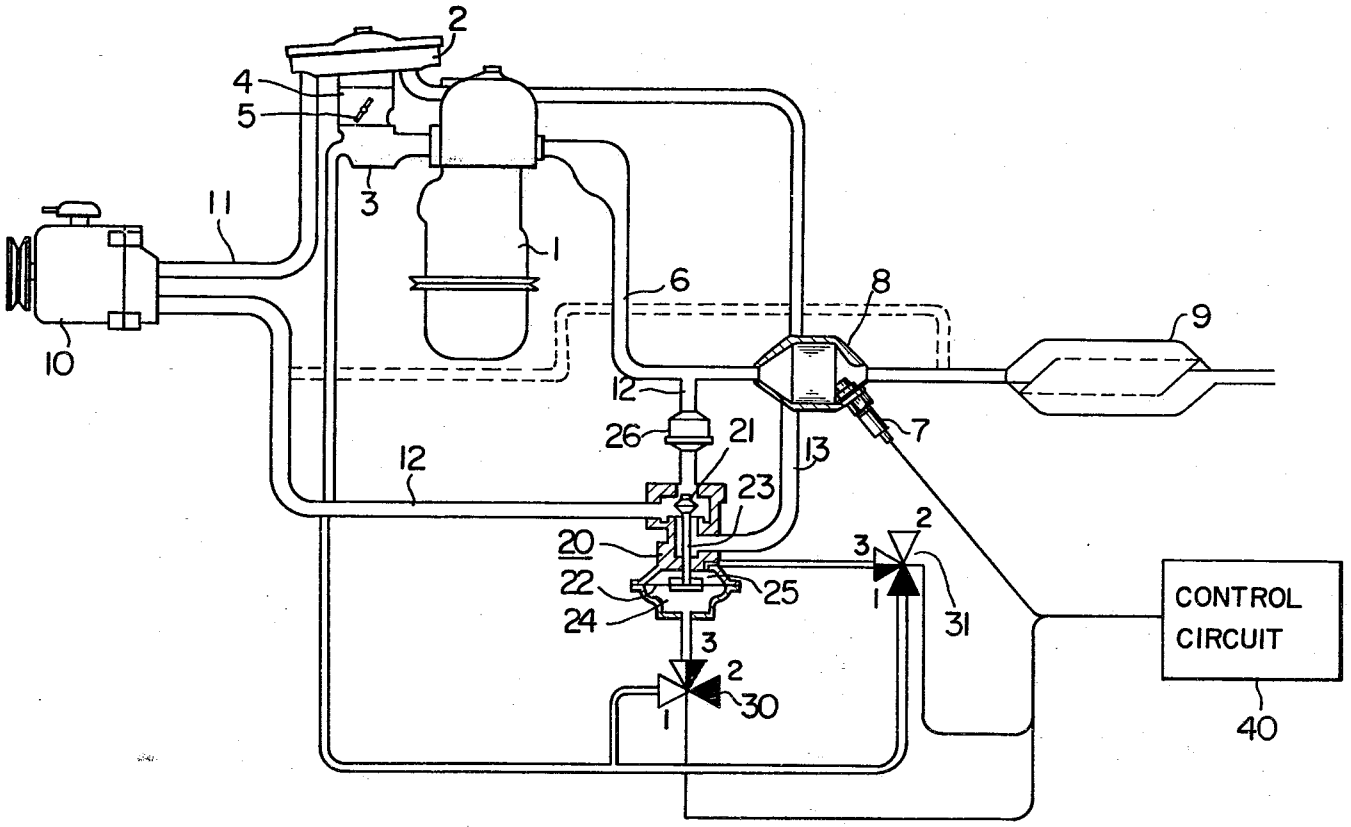
FIG. 2 is a schematic view of a first embodiment of a secondary air supply apparatus in accordance with the present invention.
Figure 5:
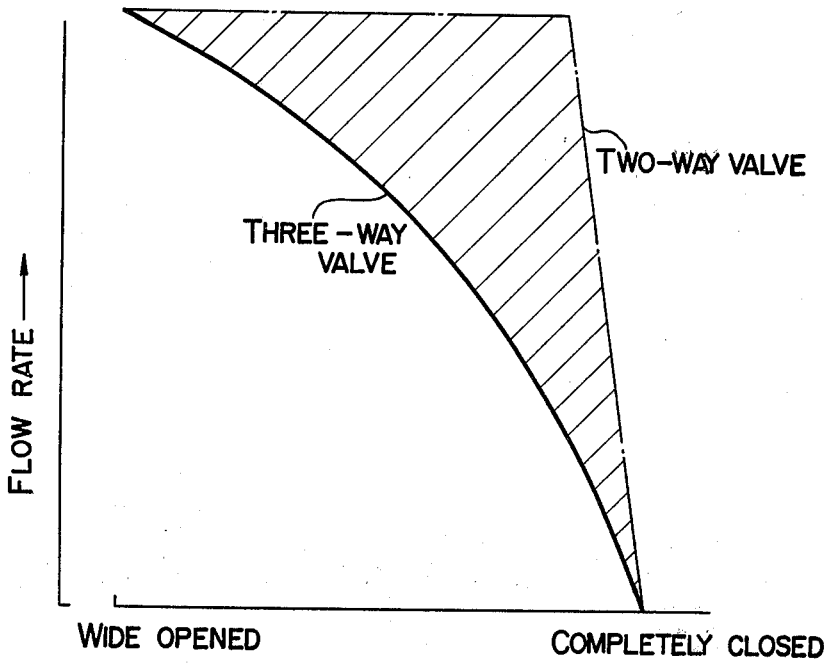
FIG. 5 shows the flow characteristics of a two-way valve and of a three-way valve.

The advantage of the three-way valve 20 used in the present invention over a two-way valve which merely opens or closes the supply pipe (so that the bypass pipe shown in FIG. 2 is eliminated) may be well understood from FIG. 5. That is, even when the two-way valve is opened very slightly, the flow rate is almost equal to that when the valve is wide opened, and even when the valve is being closed, the flow rate almost remains unchanged and is equal to the flow rate when wide opened immediately before the valve is closed. On the other hand, when the three-way valve is wide opened, relief operation is not effected whereas when it is completely closed, the relief operation is fully carried out, the degree of reliefing being controlled in response to the degree of opening of the valve. More particularly, as indicated by the solid curve in FIG. 5, the secondary air to be supplied into the exhaust pipe 6 is gradually decreased in quantity as the three-way valve 20 is gradually closed. On the other hand, with the two-way valve, the secondary air substantially equal in quantity to that when the valve is wide opened keeps flowing into the exhaust pipe 6 immediately before the valve is completely closed as indicated by the one-dot-chain line curve in FIG. 5. As a result, with the two-way valve the excess secondary air corresponding to the hatched area in FIG. 5 flows into the exhaust pipe as compared with the three-way valve so that satisfactory air-fuel ratio controllability cannot be obtained.

Figure 6:
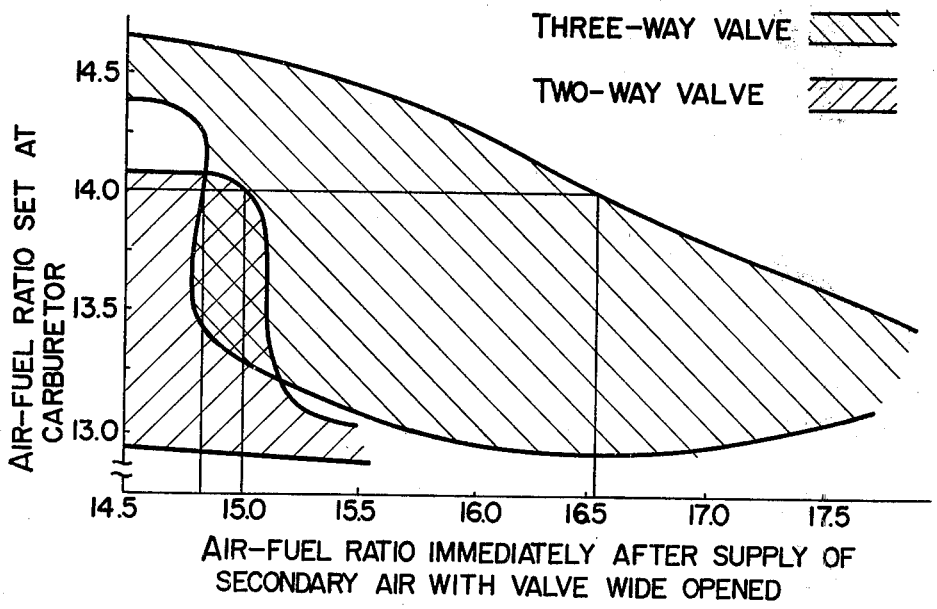
FIG. 6 shows the pollutant purification characteristics when a two-way valve and a three-way valve are used, the hatched areas indicating the operating regions at which the effficient pollutant removal may be attained.

With the two- and three-way valves, the tests were conducted to compare the pollutant purifying ability of the reactor 9, and the results were plotted in FIG. 6. That is, the air-fuel ratio immediately after the supply of secondary air is plotted along the abscissa whereas the air-fuel ratio set by the carburetor, along the ordinate. In the tests, the average "exhaust-gas air-fuel ratio" was maintained at or very close to the theoretical air-fuel ratio.

In FIG. 6 the hatched areas show the regions where more than 90% of CO and HC and more than 80% of NOx are purified by the reactor. It is seen that the pollutant purifying region is by far greater with the three-way valve than with the two-way valve. In order to specifically point out the advantages of the three-way valve over the two-way valve, the variation in air-fuel ratio due to the supply of the secondary air when the air-fuel ratio is set to 14.0 by the carburetor will be described.

With the two-way valve, the variation in air-fuel ratio immediately after the supply of secondary air must be maintained between 14.5 and 15.0 so that the reactor may operate with high efficiency. In other words, in order that the reactor may operate with high efficiency, the air-fuel ratio immediately after the supply of the secondary air must be controlled within a range between 14.5 and 15.0. Otherwise, the average "exhaust-gas air-fuel ratio" is out of the hatched region in FIG. 1, resulting in the decrease in pollutant purifying ability.

With the three-way valve, the variation in air-fuel ratio immediately after the supply of the secondary air may be extended to a range between 14.8 and 16.5, and with this range the reactor may operate highly efficiently. Therefore in the secondary air supply apparatus utilizing the three-way valve in accordance with the present invention, the production variety of carburetors, air pumps and so on may be satisfactory compensated, and the average "exhaust-gas air-fuel ratio" may be maintained at an optimum ratio in an extremely simple manner.

Next referring to FIG. 7, a modification of the three-way valve in accordance with the present invention will be described which is provided with means for controlling the volumes of the first and second pressure chambers 24 and 25. The means for controlling the volumes of the first and second pressure chambers 24 and 25 consists of an accordion-like bellows 114, an adjusting screw 115 for adjusting the volume of a chamber defined within the bellows 114, and a locking nut 116. The bellows 114 is endowed with such rigidity that its deformation will not occur even when the pressure is exerted thereupon. The volumes of the first and second pressure chambers 24 and 25 may be adjusted by changing the volume of the bellows 114 by extending or retracting the adjusting screw 115. More particularly, the adjustment is made in such a manner that the volume of the first pressure chamber 24 when the diaphragm 22 is displaced upward, causing the valve body 21 to wide open the supply pipe 12 may be equal to the volume of the second pressure chamber 25 when the diaphragm 22 is displaced downward, causing the valve body 21 to completely close the supply pipe 12. Then the difference in response between when the valve is being opened and when the valve is being closed may be eliminated.

When there exists the difference in volume between the first and second pressure chambers 24 and 25, the difference in response is resulted so that the "exhaust-gas air-fuel ratio" slightly deviates from the desired or reference ratio X. If the volume of the first pressure chamber 24 is greater than the volume of the second pressure chamber 25, the response is degraded when the valve is opened so that the secondary air may not be supplied in sufficient quantity and consequently the "exhaust-gas air-fuel ratio" becomes smaller than the reference ratio X. (That is, the richer air-fuel mixture is resulted.) On the other hand when the volume of the second pressure chamber 25 is greater than the volume of the first pressure chamber 24, the response is degraded when the valve is being closed so that the supply of secondary air may be too much and consequently the "exhaust-gas air-fuel ratio" becomes higher than the reference ratio X. (That is, the leaner air-fuel mixture is resulted.)

Figure 8:
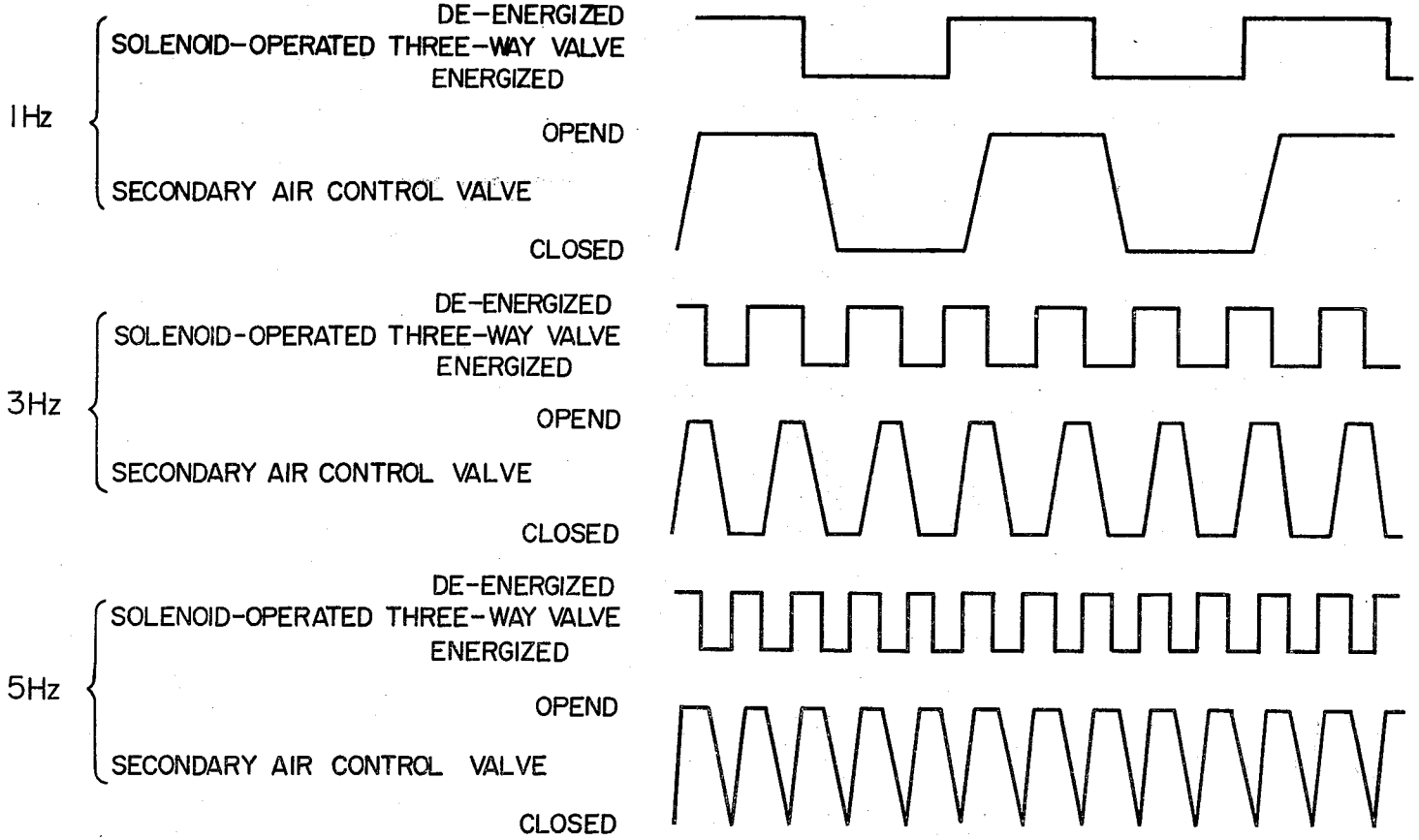
FIG. 8 is a diagram used for the explanation of operation of a three-way valve.

Next referring to FIG. 8 the mode of operation of the secondary air control valve 21 will be described when the volume of the second pressure chamber 25 is greater than that of the first pressure chamber 24 and the ratio of the energization period to the de-energization period of each of the first and second three-way valves 30 and 31 is 1:1. Since the volume of the second pressure chamber 25 is greater than the volume of the first pressure chamber 24, the response is not satisfactory when the valve 21 is being closed so that the secondary air is excessively supplied into the exhaust pipe; that is, the excess supply of secondary air is resulted. This tendency becomes more pronounced as the frequency of energization of the first and second solenoid operated three-way valves 30 and 31 is increased.

Figure 7:
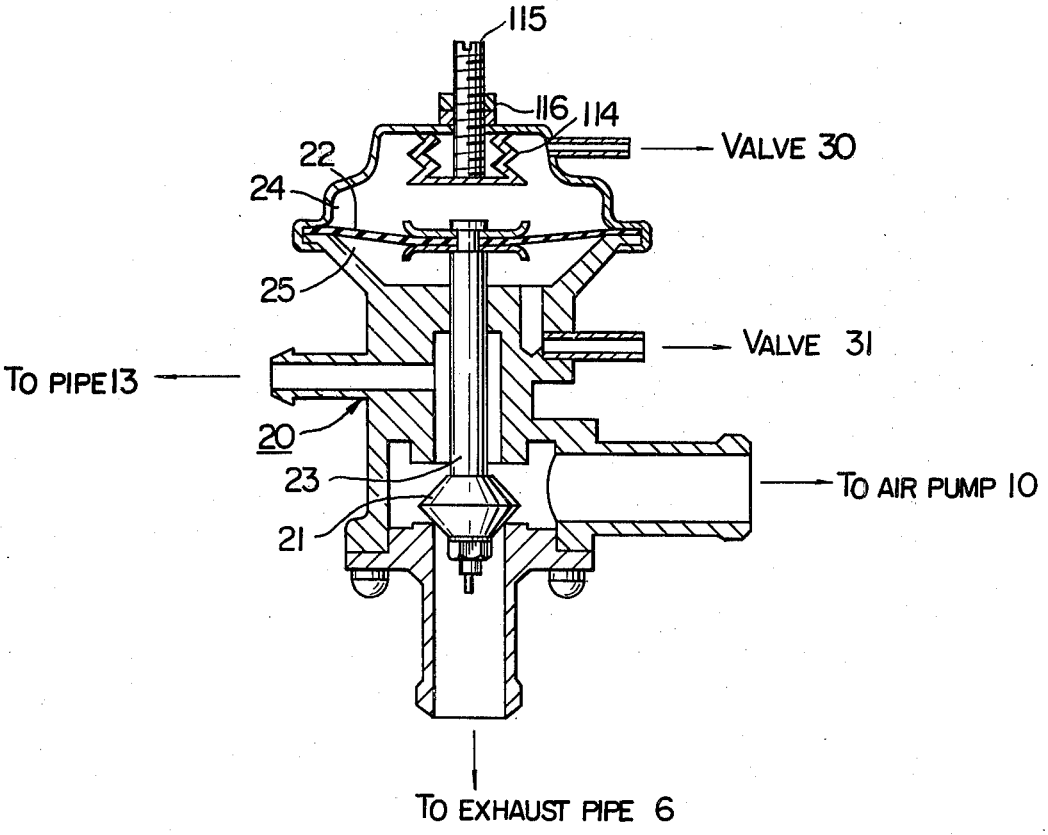
FIG. 7 is a schematic sectional view, on enlarged scale, of a modification of the three-way valve used in the first embodiment.

Since the modification of the three-way valve shown in FIG. 7 is provided with the pressure chamber volume adjusting means of the type described, the ratio between the volumes of the first and second pressure chambers 30 and 31 may be suitably adjusted so that the response may be made equal in both of valve opening and valve closing and consequently the above problem may be solved.

Next referring to FIG. 9 the second embodiment of the secondary air supply apparatus in accordance with the present invention will be described. The second embodiment is substantially similar in construction to the first embodiment shown in FIG. 2 except that instead of the three-way valve 20 and the first and second solenoid-operated three-way valves 30 and 31, a solenoid-operated three-way valve 200 is used.

The valve 200 consists of a first or intake port 201 in communication with a first supply pipe 12*a*, a second or supply port 202 in communication with a second supply pipe 12*b*, a third or bypass port 203 in communication with the bypass pipe 13, a valve body 204 carried by a movable core or plunger 205 for selectively communicating the intake port 201 with the supply or bypass port 202 or 203, a first or left coil 206 mounted at the left end and adapted to pull the plunger 205 and hence the valve body 204 to the left when energized, and a second or right coil mounted at the right end and adapted to pull the plunger 205 and hence the valve body 204 to the right when energized.

Next the mode of operation of the solenoid-operated three-way valve 200 with the above construction will be described. When the air-fuel ratio is small (that is, in case of the richer air-fuel mixture), the second or right coil 207 is energized to cause the valve body 204 to close the bypass port 203 while wide opening the supply port 202 so that the secondary air discharged from the air pump 10 flows through the first supply pipe 12*a*, the intake port 201, the supply port 202, and second supply pipe 12*b*, and a nonreturn valve 26 into the exhaust pipe 6. On the other hand, when the air-fuel ratio is higher (that is, in case of the leaner air-fuel mixture), the first or left coil 206 is energized to cause the valve body 204 to close the supply port 202 while opening the bypass port so that the secondary air flows back through the bypass pipe 13 to the air cleaner 2.

The springs supporting the core or plunger 205 may be eliminated. In controlling the valve body 204, a spring may be used to cause the valve body to skip (with a short spring, when the valve body starts to move, the sufficient spring action may not be provided so that the valve body moves fast, but when the spring pressure builds up, the valve body is slowed down). In addition, the rate of opening of the valve may be decreased with time.

The important features of the three-way valve in accordance with the present invention are that when the supply path is wide opened, no relief operation is effected; that is, no secondary air is returned to the air cleaner whereas when the supply path is completely closed, all of the secondary air is relieved and returned to the air cleaner and that when the supply path is partly opened, the secondary air is relieved and returned in a volume depending upon the discharge pressure of the air pump 10, the discharge quantity thereof, the diameters of the pipes used, the degree of restriction and so on so that an optimum quantity of secondary air may be charged into the exhaust pipe 6.

Figure 9:
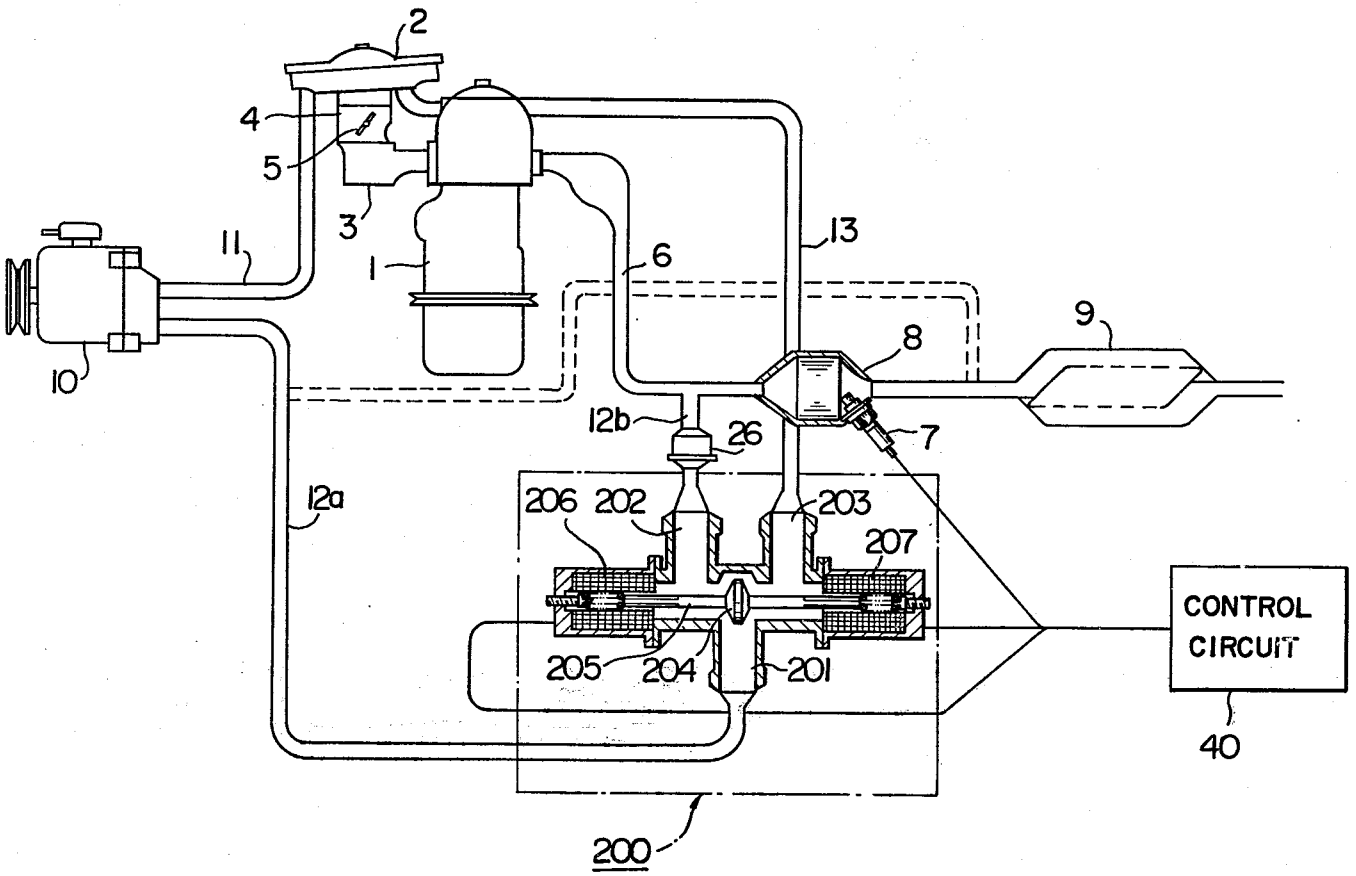
FIG. 9 is a schematic view of a second embodiment of the present invention.
Figure 10:
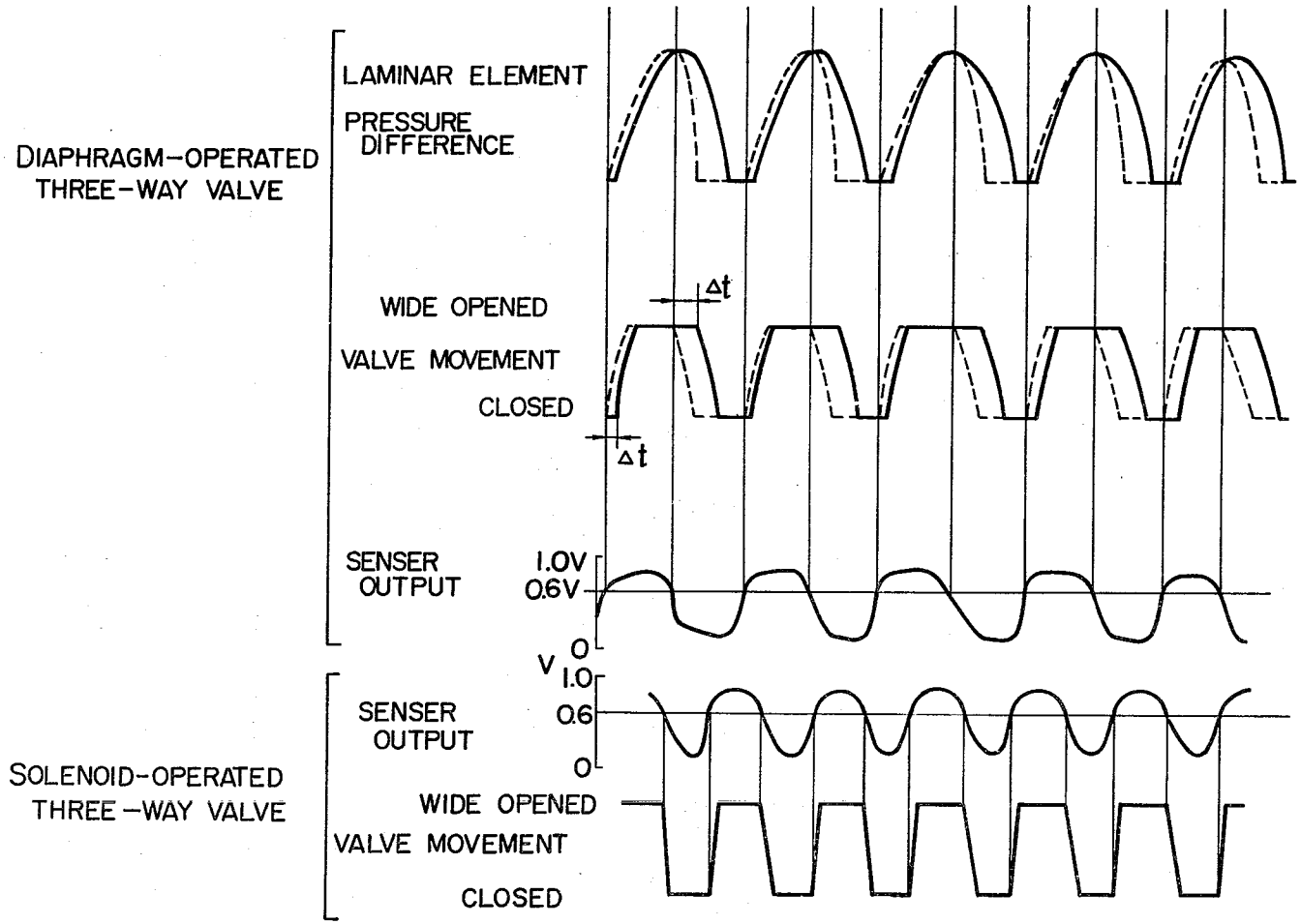
FIG. 10 is a diagram used for the explanation of the difference in operation between a diaphragm-operated three-way valve and a solenoid-operated three-way valve.

The secondary air supply apparatus utilizing the solenoid-operated three-way valve as shown in FIG. 9 was compared with the secondary air supply apparatus utilizing the diaphragm-operated three-way valve as shown in FIG. 2 only under the conditions that the carburetor provides an air-fuel mixture with the basic air-fuel ratio of 13.5 and that the air-fuel ratio with the control valve wide opened (that is, immediately after the supply of secondary air) is set to 15.0, and the results are plotted in FIG. 10. With the diaphragm-operated three-way valve, its actual and ideal responses are indicated by the solid and broken lines, respectively, and it is clearly seen that there exists a considerable time lag $\Delta t$ between the output of the air-fuel ratio senser 7 and the actual valve operation. On the other hand, the solenoid-controlled three-way valve has no time lag at all so that it may operate at a higher on-off frequency.

Figure 11:
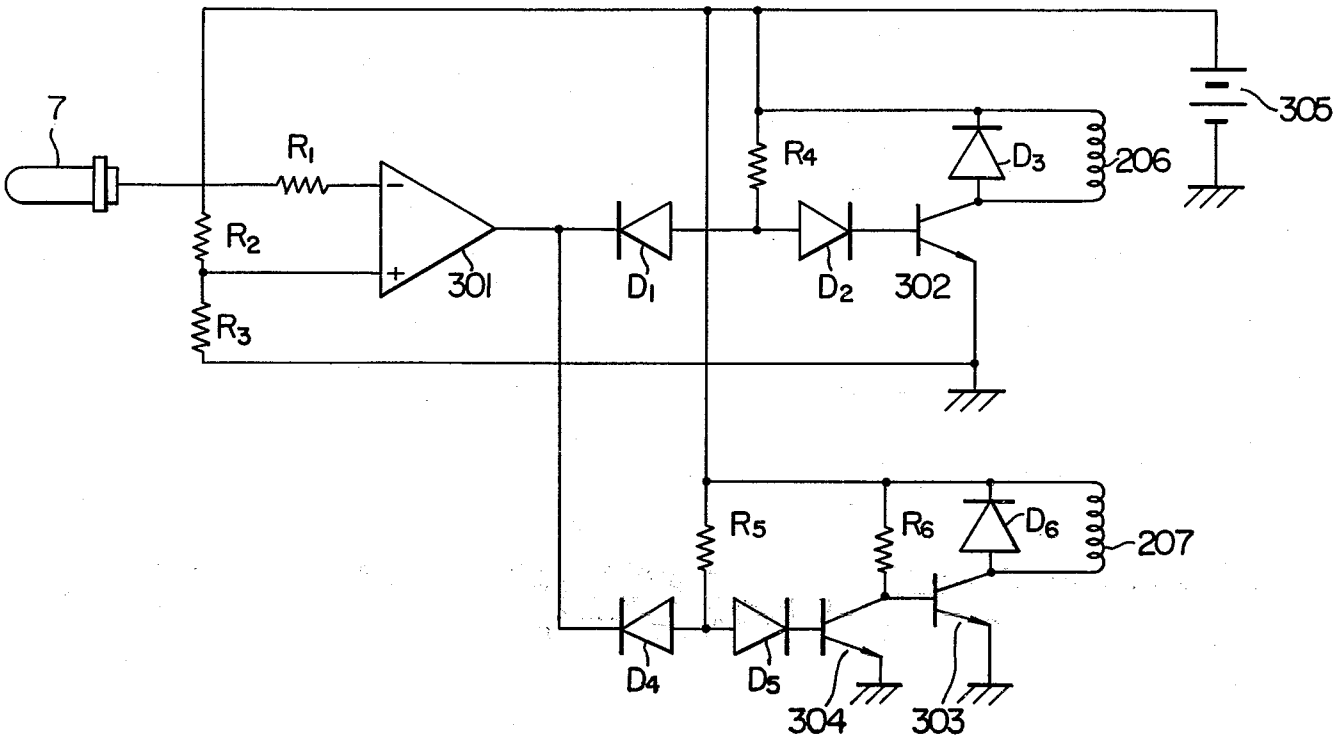
FIG. 11 is a diagram of a control circuit of the second embodiment.

Next the control circuit 40 of the three-way valve 200 will be described in detail with reference to FIG. 11. It consists of a comparator 301 for comparing the output voltage transmitted through R-1 from the senser 7 with a reference voltage set by a second resistor R-2 and a third resistor R-3, diodes D-1 through D-6, transistors 302 through 304, and a power supply or battery 305. When the "exhaust-gas air-fuel ratio" is smaller than the reference ratio X (See FIG. 3), the output voltage from the senser 7 impressed on the negative terminal of the comparator 301 exceeds the reference voltage V (See also FIG. 3) impressed on the positive terminal so that the output of the comparator 301 is "0" as in the first embodiment. On the other hand when the "exhaust-gas air-fuel ratio" is higher than the reference ratio X, the output voltage from the senser 7 is lower than the reference voltage V so that the comparator 301 outputs "1".

When the output from the comparator 301 is "0", the second coil 207 is energized while the first coil 206 remains de-energized so that the solenoid-operated three-way valve 200 wide opens the supply path. On the other hand, when the output is "1", the first coil 206 is energized whereas the second coil 207 remains de-energized so that the secondary air supply path is closed and all of the secondary air is relieved or bypassed.

As the solenoid-operated three-way valve 200 alternately opens and closes the secondary air supply path, the secondary air is charged into the exhaust pipe 6 in a pulse-like manner so that the "exhaust-gas air-fuel ratio" of the exhaust gases to be charged into the reactor 9 cyclically changes but it becomes equal to the reference ratio on the average. Thus the efficient operation of the reactor 9 may be ensured as in the case of the first embodiment.

With the solenoid-operated three-way valve in accordance with the present invention, the cyclic secondary air supply may be accomplished at a high rate so that the exhaust gases and the secondary air may be satisfactorily mixed with each other before they are charged into the reactor with the resultant decrease in deviation of the air-fuel ratio. Thus the pollutant purifying capability of the reactor 9 may be considerably improved.

It is preferable in both the first and second embodiments that when the reactor 9 uses a reducing catalyst, the "exhaust-gas air-fuel ratio" may be in a range between 13.5 and 14.7 and be controlled in a manner substantially similar to that described above with the three-way catalyst.

When the reactor 9 consists of an exdizing catalyst or afterburner, the "exhaust-gas air-fuel ratio" is preferably within a range between 15.5 and 19.0. To this end, the secondary air supply apparatus is so controlled that the air-fuel ratio may be 14.7 at or in the vicinity of the air-fuel ratio senser 7, and the supply pipe 12 or 12*a* is branched as indicated by the broken lines in FIGS. 2 and 9 and is communicated with the exhaust pipe 6 upstream of the reactor 9 but downstream of the air-fuel ratio senser 7 so that a small quantity of secondary air may be always supplied to the exhaust pipe 6 upstream of the reactor 9. With this arrangement the air-fuel ratio of the exhaust gases flowing into the reactor 9 may be maintained within a range between 15.5 and 19.0.

What is claimed is:

1. A secondary air supply apparatus for an internal combustion engine of the type having an intake manifold for developing a negative pressure during operation of the engine, a combustion chamber, means for supplying an air-fuel mixture to said combustion chamber, an exhaust pipe for conveying exhaust gases to the atmosphere, and reactor means disposed in said exhaust pipe for purifying the exhaust gases, said apparatus comprising:

a source of air;

a three-way valve having a first port connected to said source of air, a second port connected to said exhaust pipe upstream of said reactor means, a third port connected to said source, a valve body for selectively communicating said first port with either of said second and third ports, a diaphragm connected with said valve body, first and second diaphragm chambers formed on opposite sides of said diaphragm, respectively, said first diaphragm chamber being connected with said intake manifold through a first tube, said second diaphragm chamber being connected with said intake manifold through a second tube, and means for adjusting the volume of one of said first and second diaphragm chambers thereby to balance the volumes of said first and second diaphragm chambers;

a first signal switching valve disposed in the first tube between said first diaphragm chamber and the intake manifold;

a second signal switching valve disposed in the second tube between said second diaphragm chamber and the intake manifold;

air-fuel ratio detecting means, disposed in said exhaust pipe downstream of a portion thereof which is in communication with said second port of said three-way valve, for detecting an air-fuel ratio in the exhaust gases; and a control circuit electrically connected to said air-fuel ratio detecting means and to said first and second signal switching means for energizing the switching means in response to the output from said air-fuel ratio detecting means in such a manner that said first switching valve is switched to introduce said negative pressure to said first diaphragm chamber, while said second switching valve is switched to connect said second diaphragm chamber to the atmosphere, during a first condition wherein said air-fuel ratio detecting means detects a lower ratio than a predetermined value, and that said first switching valve is switched to connect said first diaphragm chamber to the atmosphere, while said second switching valve is switched to introduce said negative pressure to said second diaphragm chamber, in a second condition wherein said air-fuel ratio detecting means detects a higher ratio than said predetermined value, said second port of said three-way valve being connected with said first port to supply secondary air from said source to said exhaust pipe in the first condition, and said first port of said three-way valve being connected with said third port to return said secondary air to the source in said second condition, said switching operation of said three-way valve being performed only in response to differences in pressure occurring between said first and second diaphragm chambers.

2. A secondary air supply apparatus as claimed in claim 1, wherein said adjusting means is a bellows disposed in airtight relationship within said first diaphragm chamber, the volume of said bellows being outwardly adjustable.

* * * * *